US007451939B2

(12) United States Patent
Huang

(10) Patent No.: US 7,451,939 B2
(45) Date of Patent: Nov. 18, 2008

(54) MULTI-STAGE SWING HORTICULTURAL WATERING APPLIANCE

(75) Inventor: Kuo-Shu Huang, Chang Hua (TW)

(73) Assignee: Yong Yen Metal Co., Ltd., Chang Hua (TW)

( * ) Notice: Subject to any disclaimer, the term of this patent is extended or adjusted under 35 U.S.C. 154(b) by 307 days.

(21) Appl. No.: 11/427,109

(22) Filed: Jun. 28, 2006

(65) Prior Publication Data

US 2008/0006716 A1 Jan. 10, 2008

(51) Int. Cl.
*B05B 3/16* (2006.01)

(52) U.S. Cl. ..... 239/242; 239/263; 239/263.3; 239/237; 239/391; 239/393; 239/394; 239/442

(58) Field of Classification Search ..... 239/207, 239/210, 225.1, 240–244, 246, 248, 255, 239/263, 263.3, 264, 289, 380–389, 391–394, 239/436, 442, 562, DIG. 1
See application file for complete search history.

(56) References Cited

U.S. PATENT DOCUMENTS 3,269,661 A * 8/1966 Thompson ..... 239/242
4,347,981 A * 9/1982 Hayes ..... 239/394
5,683,035 A * 11/1997 Wang ..... 239/394
5,746,375 A * 5/1998 Guo ..... 239/245
6,290,146 B1 * 9/2001 Tsai ..... 239/394
6,808,129 B1 * 10/2004 Wang ..... 239/231
2006/0214023 A1 * 9/2006 Collins et al. ..... 239/242
2007/0290071 A1 * 12/2007 Wang et al. ..... 239/275
2008/0116297 A1 * 5/2008 Wang ..... 239/394

* cited by examiner

*Primary Examiner*—Len Tran
*Assistant Examiner*—Jason J Boeckmann
(74) *Attorney, Agent, or Firm*—Alan Kamrath; Kamrath & Associates PA

(57) ABSTRACT

A multi-stage swing horticultural watering appliance includes a base, a water-dispensing basin, a swing device, a spraying cover and a swing outlet pipe. The base is formed in a center thereof with a circular receiving recess for accommodation of the water-dispensing basin. An inlet hole and an outlet connector are arranged at two opposite sides of the receiving recess of the base. A plurality of inlet apertures is formed in an outer periphery of the water-dispensing basin. In the water-dispensing basin are provided with a water-supplying pipe and a plurality of water-separating boards. In use, water flows through the inlet hole of the base and into the water-dispensing basin via the inlet apertures. When the water-dispensing basin is full of water and the pressure therein reaches a certain level, the water will flow into the swing outlet pipe via the inlet hole thereof and will be sprayed out via the spraying apertures.

8 Claims, 16 Drawing Sheets

MULTI-STAGE SWING HORTICULTURAL WATERING APPLIANCE

BACKGROUND OF THE INVENTION

1. Field of the Invention

The present invention relates to a watering appliance and, more particularly to a multi-stage swing horticultural watering appliance.

2. Description of the Prior Art

Conventional horticultural watering appliances generally include the water-spraying device (as shown in FIGS. 1 and 2) for watering flowers and trees at the designated locations, and the swing type sprinkling machine as shown in FIG. 3 for irrigating the large lawn.

The water-spraying device comprises a base 10 and a spraying cover 20. An inlet connector 101 is disposed at a side of the base 10, and a circular platform 102 is arranged on the top surface of the base 10. Formed in the center of the circular platform 102 is a connecting hole 103. An inlet hole 104 is located at a side of the connecting hole 103, and a protrusive positioning rib 105 with an engaging groove 1051 is located at another side of the connecting hole 103. A plurality of spraying apertures 201 of different shapes is formed in the top surface of the spraying cover 20 and is arranged in an annular manner. A plurality of annularly arranged fasteners 202 is formed on the bottom surface of the spraying cover 20 for engaging with the engaging hole 103 of the base 10. A plurality of stopping protrusions 203 is formed around the outer edge of the plurality of spraying apertures 201. When the spraying cover 20 is rotated to a position at which one of the stopping protrusions 203 is engaged in the engaging groove 1051 of the positioning rib 105, the plurality of spraying apertures 201 will be aligned with the inlet hole 104. After the inlet connector 101 that is in communication with the inlet hole 104 is connected to water supply, the water can be sprayed via the spraying apertures 201.

The swing type sprinkling machine comprises a base 30, a controller 40 and an outlet pipe 50. An inlet hole 301 is formed in a side of the base 30 for guiding the water into the base 30, and then the water is discharged via the outlet pipe 50. A plurality of spraying apertures 501 is formed in the surface of the outlet pipe 50, and the outlet pipe 50 is slightly arc-shaped such that the water can be sprayed via the spraying apertures 501 in a fanlike fashion. The controller 40 controls the swing angle of the outlet pipe 50.

These two types of horticultural watering appliances have different uses. Therefore, the user who has flowers, trees, and lawn usually has to buy both of the two types of horticultural watering appliances at the same time. This is not only expensive but also inconvenient.

The present invention has arisen to mitigate and/or obviate the afore-described disadvantages.

SUMMARY OF THE INVENTION

The primary objective of the present invention is to provide a multi-stage swing horticultural watering appliance.

A multi-stage swing horticultural watering appliance in accordance with present invention comprises: a base, a water-dispensing basin, a swing device, a spraying cover and a swing outlet pipe. The base is formed in a center thereof with a circular receiving recess. The water-dispensing basin is received in the circular receiving recess and is rotatable step by step. The swing device is installed in the water-dispensing basin and includes a turbine wheel, a drive member, a follower, a sleeve, a driven shaft, a swing arm, a link ring and a positioning member. The turbine wheel is rotatably mounted on two supporting rods inside the water-dispensing basin. The drive member is pivotally mounted on a hollow pillar inside the water-dispensing basin and meshed with the turbine wheel and the follower by teeth. The follower is mounted on an end of the driven shaft. The sleeve is mounted on a mid portion of the driven shaft and then is placed on the positioning member mounted on supporting columns inside the water-dispensing basin. Another end of the driven shaft is pivoted to an end of the swing arm, and another end of the swing arm is pivoted to a link rod of the link ring. The spraying cover is fixed on the water-dispensing basin by high frequency welding. The multi-stage swing horticultural watering appliance is characterized in that: an inlet hole and an outlet connector are arranged at two opposite sides of the receiving recess of the base, a plurality of inlet apertures is formed in an outer periphery of the water-dispensing basin, and the water-dispensing basin is provided with a water-supplying pipe and a plurality of water-separating boards. In use, water flows through the inlet hole of the base and into the water-dispensing basin via the inlet apertures. A rectangular groove is formed in the spraying cover for accommodation of the swing outlet pipe. A through hole is formed in one end of the rectangular groove. The swing outlet pipe is formed with a plurality of spraying apertures. One end of the swing outlet pipe passes through the through hole of the rectangular groove and is connected to the link ring of the swing device, and in this one end of the swing outlet pipe is formed an inlet hole. Water flow pushes the swing device to swing, thus driving the swing outlet pipe to swing back and forth, when the water-dispensing basin is full of water and the pressure therein reaches a certain level, the water will flow into the swing outlet pipe via the inlet hole thereof and will be sprayed out via the spraying apertures.

DETAILED DESCRIPTION OF THE PREFERRED EMBODIMENTS

Figure 1:
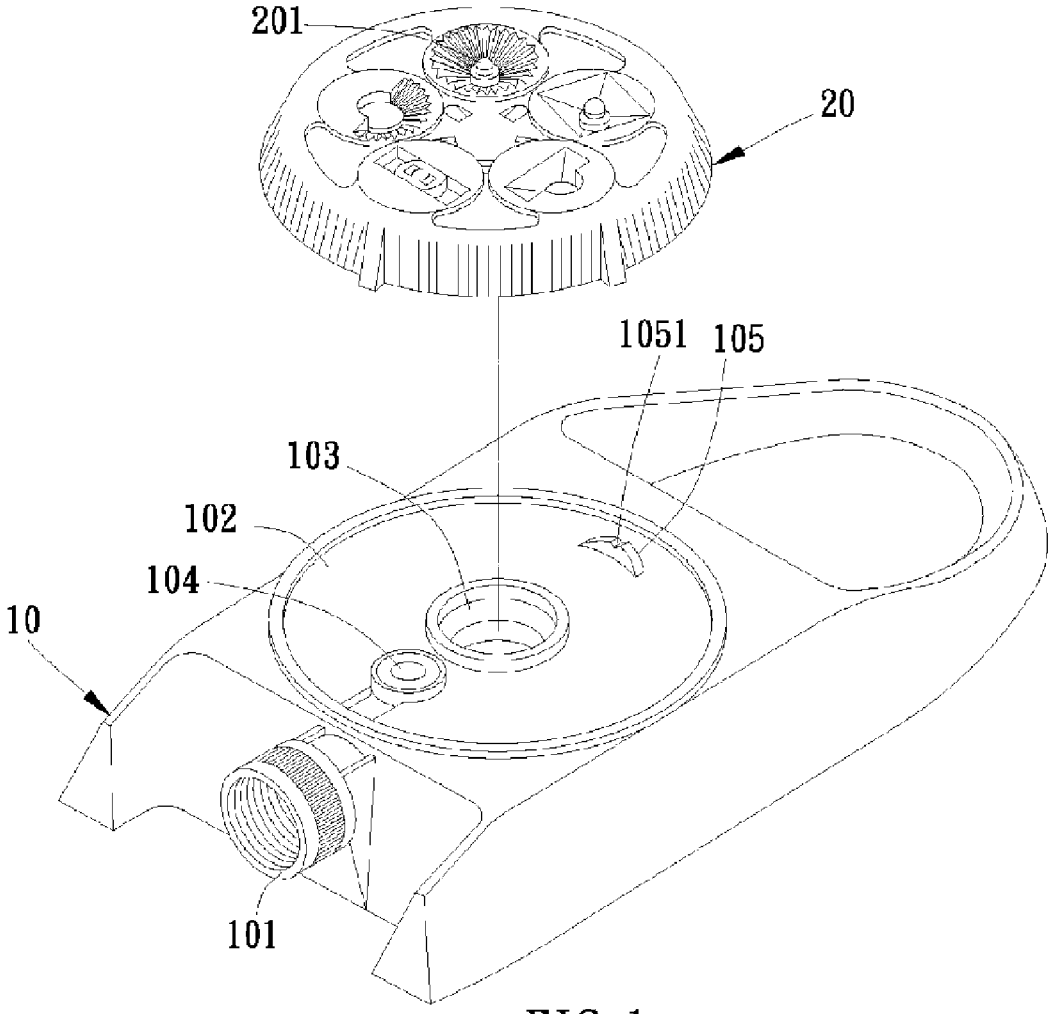
FIG. 1 PRIOR ART
FIG. 1 is an exploded view of a conventional watering appliance.
Figure 2:
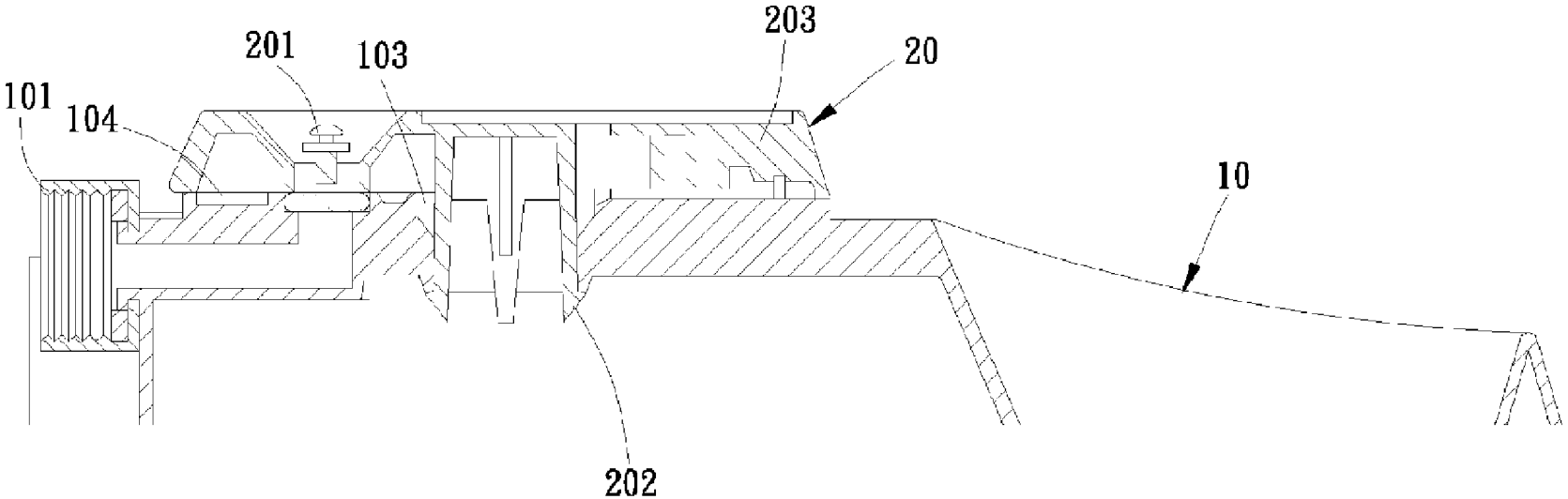
FIG. 2 PRIOR ART
FIG. 2 is a cross sectional view of a conventional watering appliance.
Figure 3:
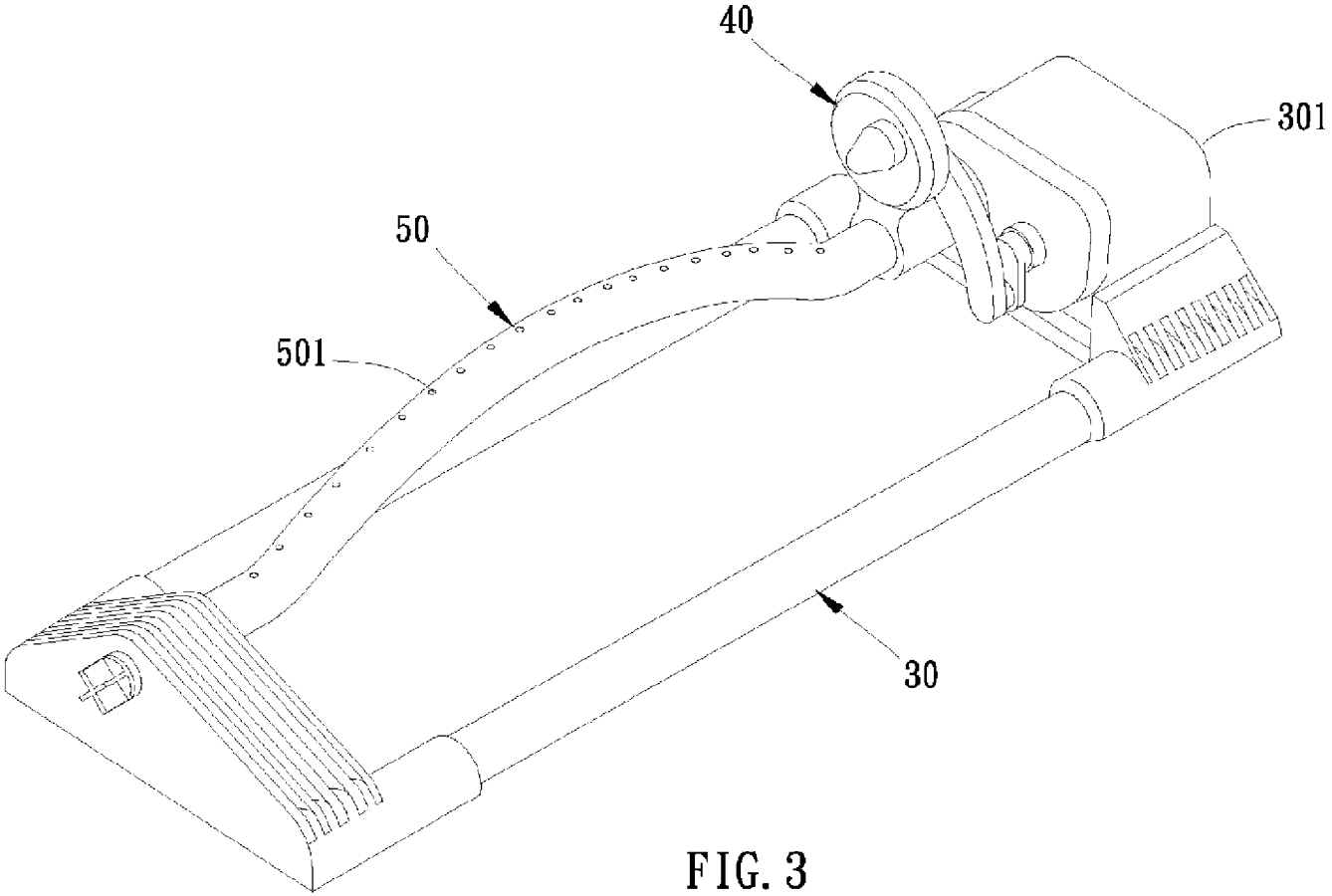
FIG. 3 PRIOR ART
FIG. 3 shows another conventional watering appliance.
Figure 4:
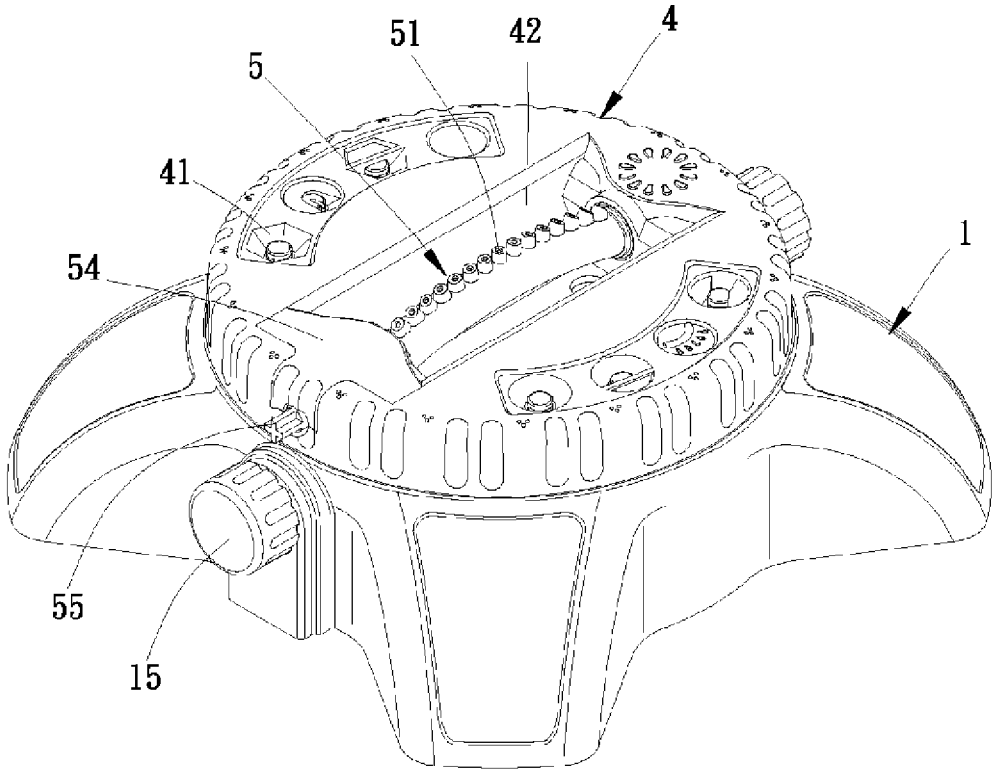
FIG. 4 is an assembly view of a multi-stage swing horticultural watering appliance in accordance with the present invention.
Figure 5:
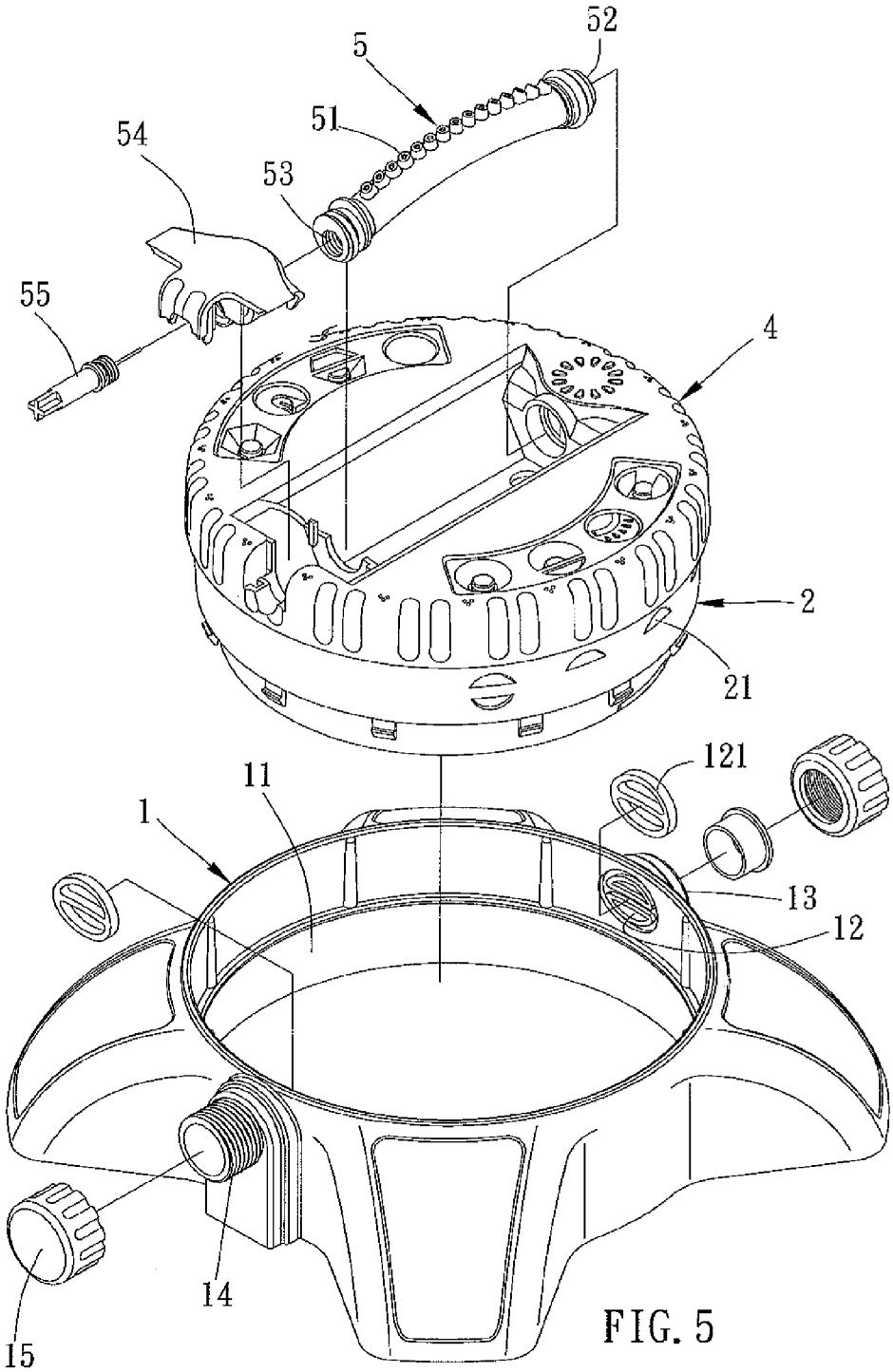
FIG. 5 is an exploded view of a multi-stage swing horticultural watering appliance in accordance with the present invention.
Figure 6:
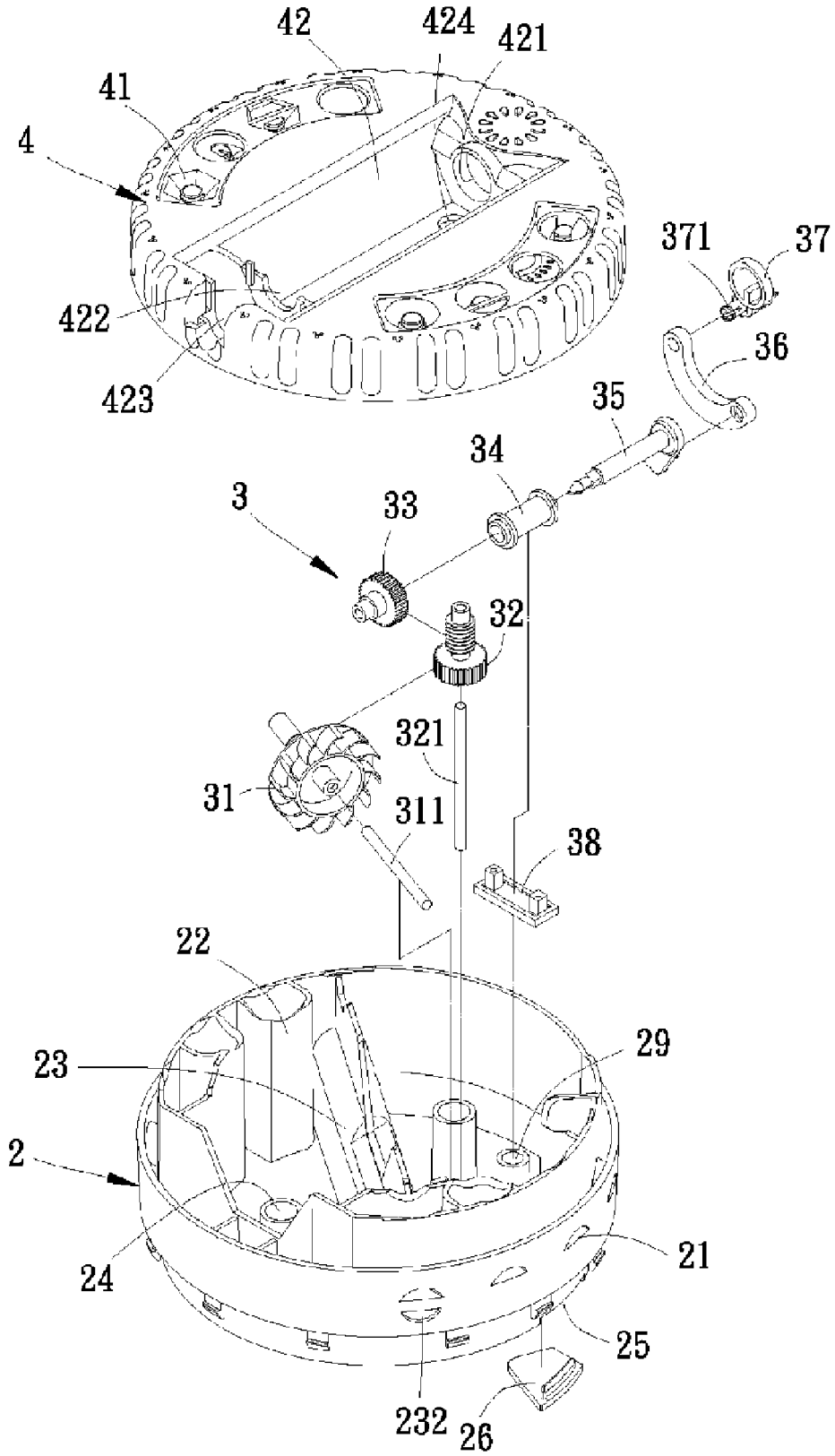
FIG. 6 is an exploded view of a water-dispensing basin, a swing device and a spraying cover in accordance with the present invention.
Figure 7:
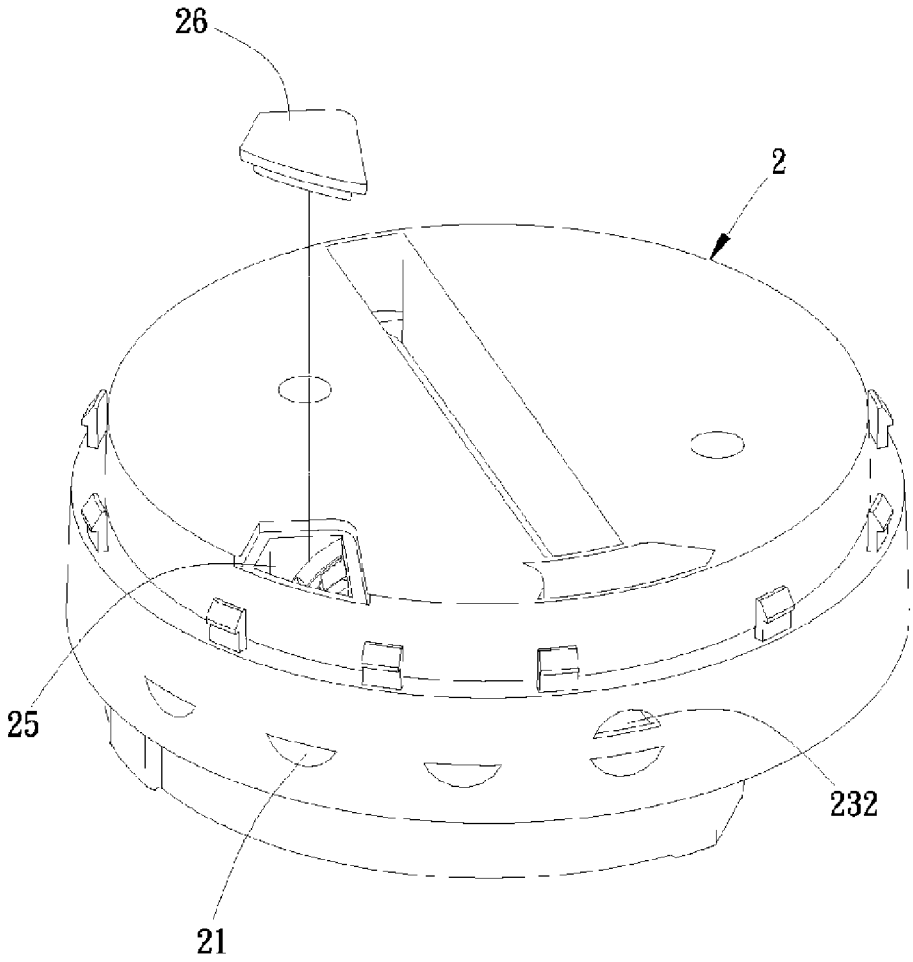
FIG. 7 is a perspective view showing the rear of the water-dispensing basin in accordance with the present invention.
Figure 8:
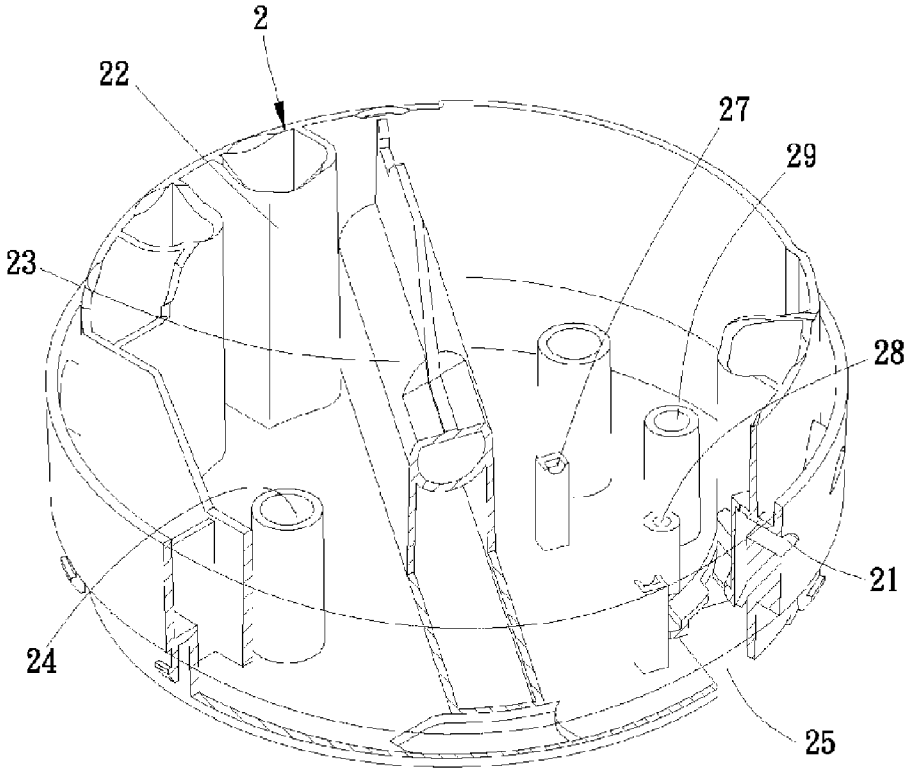
FIG. 8 is a perspective view of the water-dispensing basin in accordance with the present invention.
Figure 9:
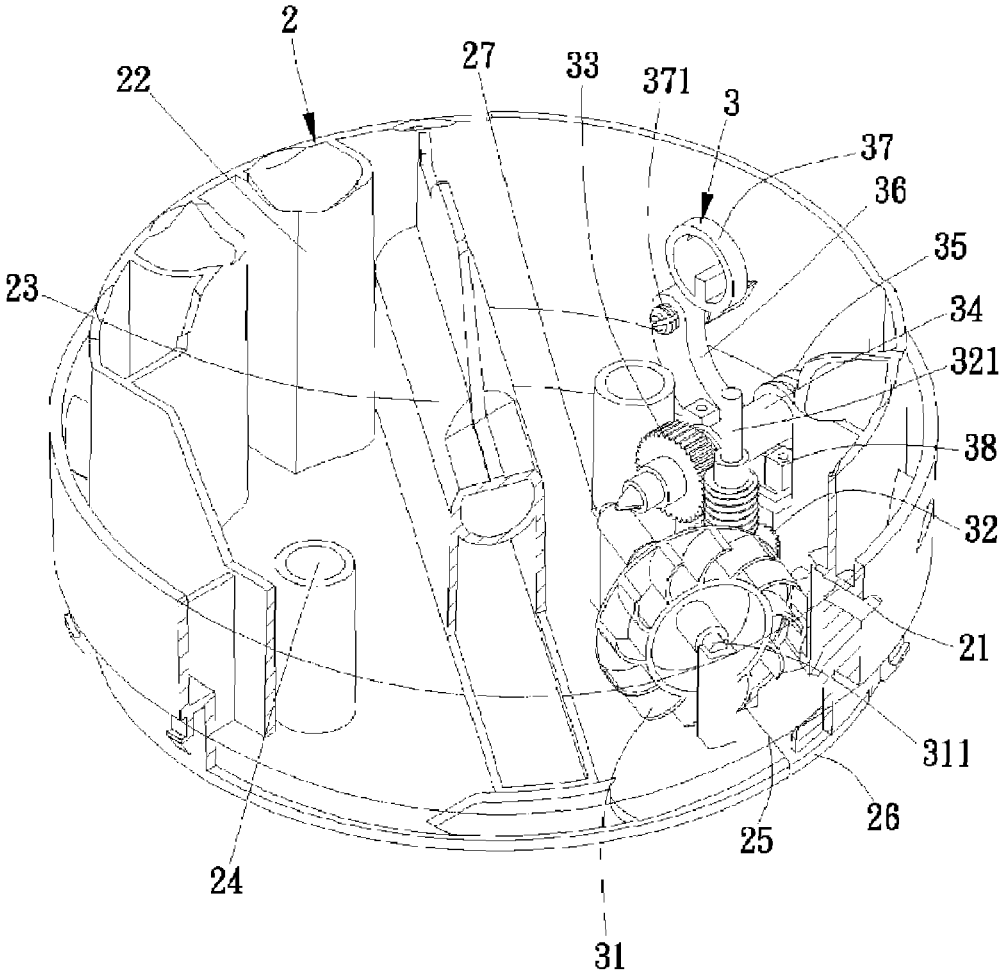
FIG. 9 is a perspective assembly view showing the water-dispensing basin and the swing device in accordance with the present invention.

The present invention will be more clear from the following description when viewed together with the accompanying drawings, which show, for purpose of illustration only, the preferred embodiment in accordance with the present invention.

Referring to FIGS. 4-9, a horticultural watering appliance in accordance with the present invention comprises a base 1, a water-dispensing basin 2, a swing device 3, a spraying cover 4 and a swing outlet pipe 5.

The base 1 is formed in the center thereof with a circular receiving recess 11, an inlet hole 12 is formed in a side of the receiving recess 11, and a -shaped sealing ring 121 is disposed in the inlet hole 1 2. An inlet connector 13 is connected to the outer side of the inlet hole 12. An outlet connector 14 is disposed at another side of the receiving recess 11 and is sealed with a cover 15 which is screwed on the outlet connector 14.

The water-dispensing basin 2 is fastened in the receiving recess 11 of the base 1 by snaps and is rotatable step by step. A plurality of arc-shaped inlet apertures 21 is formed in the outer periphery of the water-dispensing basin 2, and arranged on the inner periphery of the water-dispensing basin 2 is a plurality of water-separating boards 22 located correspondingly to the inlet apertures 21. In the water-dispensing basin 2 are provided a water-supplying pipe 23 arranged in the radial direction thereof and two discharge pipes 24. A circular hole 231 is formed at one end of the water-supplying pipe 23, and an arc-shaped hole 232 is formed at another end of the water-supplying pipe 23 for mating with the inlet apertures 21. A die hole 25 in the bottom surface of the water-dispensing basin 2 is sealed with a sealing cover 26 by high frequency.

The swing device 3 is installed in the water-dispensing basin 2 and includes a turbine wheel 31, a drive member 32, a follower 33, a sleeve 34, a driven shaft 35, a swing arm 36, a link ring 37 and a positioning member 38. A shaft 311 is inserted through the center of the turbine wheel 31 and is mounted on two supporting rods 27 inside the water-dispensing basin 2, so that the turbine wheel 31 is rotable. Another shaft 321 is inserted in the drive member 32, and the drive member 32 is pivotally mounted on a hollow pillar 28 inside the water-dispensing basin 2 by the shaft 321 and is meshed with the turbine wheel 31 and the follower 33 by teeth for purposes of transmission of torque. The follower 33 is mounted on an end of the driven shaft 35. The sleeve 34 is mounted on the mid portion of the driven shaft 35 and then is placed on the positioning member 38 mounted on the supporting columns 29 inside the water-dispensing basin 2. Another end of the driven shaft 35 is pivoted to the end of the swing arm 36, and another end of the swing arm 36 is pivoted to a link rod 371 of the link ring 37.

The spraying cover 4 is fixed on the water-dispensing basin 2 by high frequency welding, the swing device 3 is clamped between the spraying cover 4 and the water-dispensing basin 2, and a plurality of spraying apertures 41 of different shapes is formed in the top surface of the spraying cover 4 and is located around a rectangular groove 42 in the center of the top surface of the spraying cover 4. Formed in one end of the rectangular groove 42 is a through hole 421, and formed in another end thereof are a mounting board 422 and a notch 423. Two discharge holes 424 are formed in the bottom of the rectangular groove 42 for mating with the two discharge pipes 24 of the water-dispensing basin 2.

The swing outlet pipe 5 is an arc-shaped hollow pipe installed in the rectangular groove 42 of the spraying cover 4, and a plurality of spraying apertures 51 is formed in the top surface of swing outlet pipe 5. One end of the swing outlet pipe 5 passes through the through hole 421 of the rectangular groove 42 and is connected to the link ring 37 of the swing device 3, and in this end of the swing outlet pipe 5 is formed an inlet hole 52. Another end of the swing outlet pipe 5 is mounted on the mounting board 422 and is fixed thereon by a fixing board 54, the swing outlet 5 is disposed in a swayable manner, and in this another end of the swing outlet 5 is formed a threaded hole 53 for screwing with a clean rod 55. The clean rod 55 is detachable and can be used to dredge and clean the spraying apertures 51.

Figure 10:
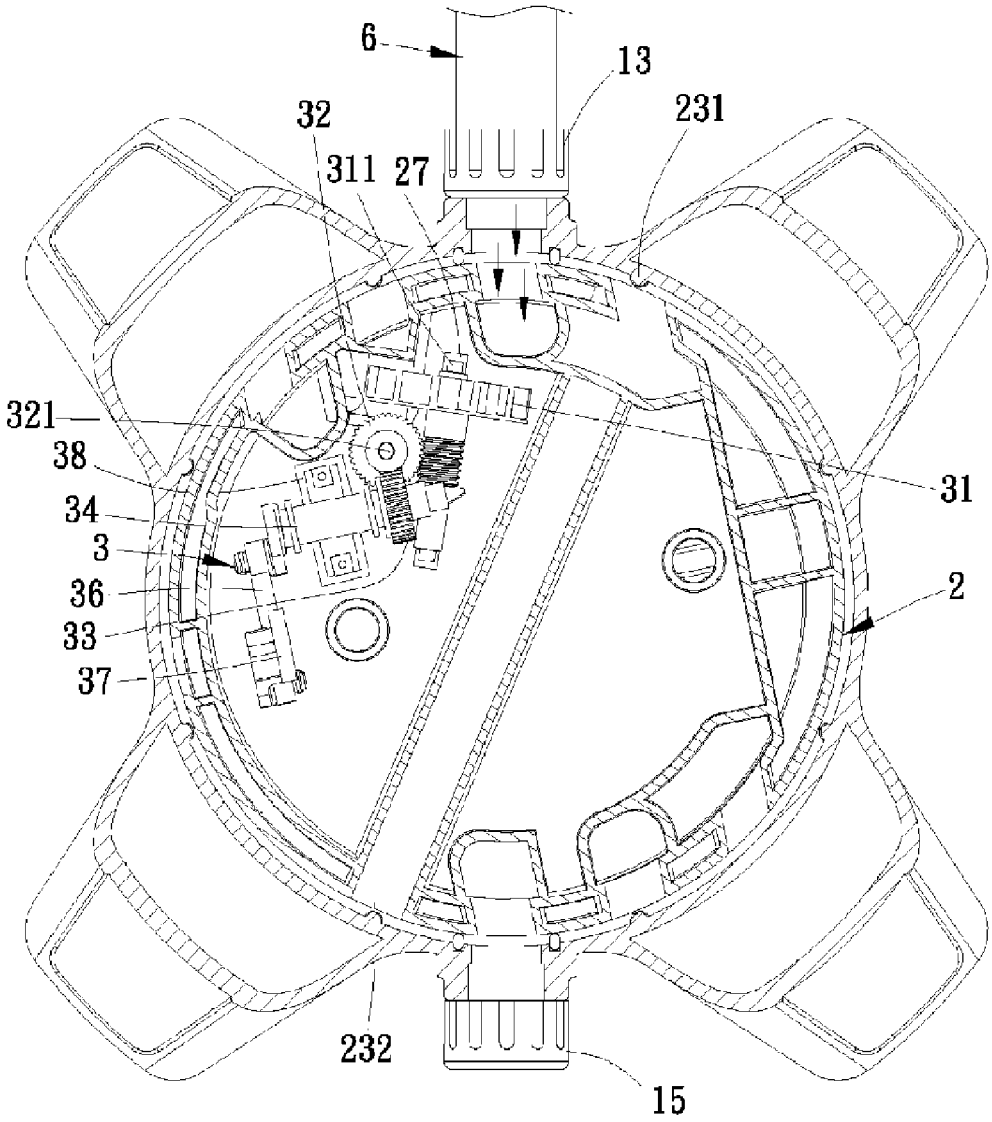
FIG. 10 is an operational view showing the spraying cover in accordance with the present invention.
Figure 11:
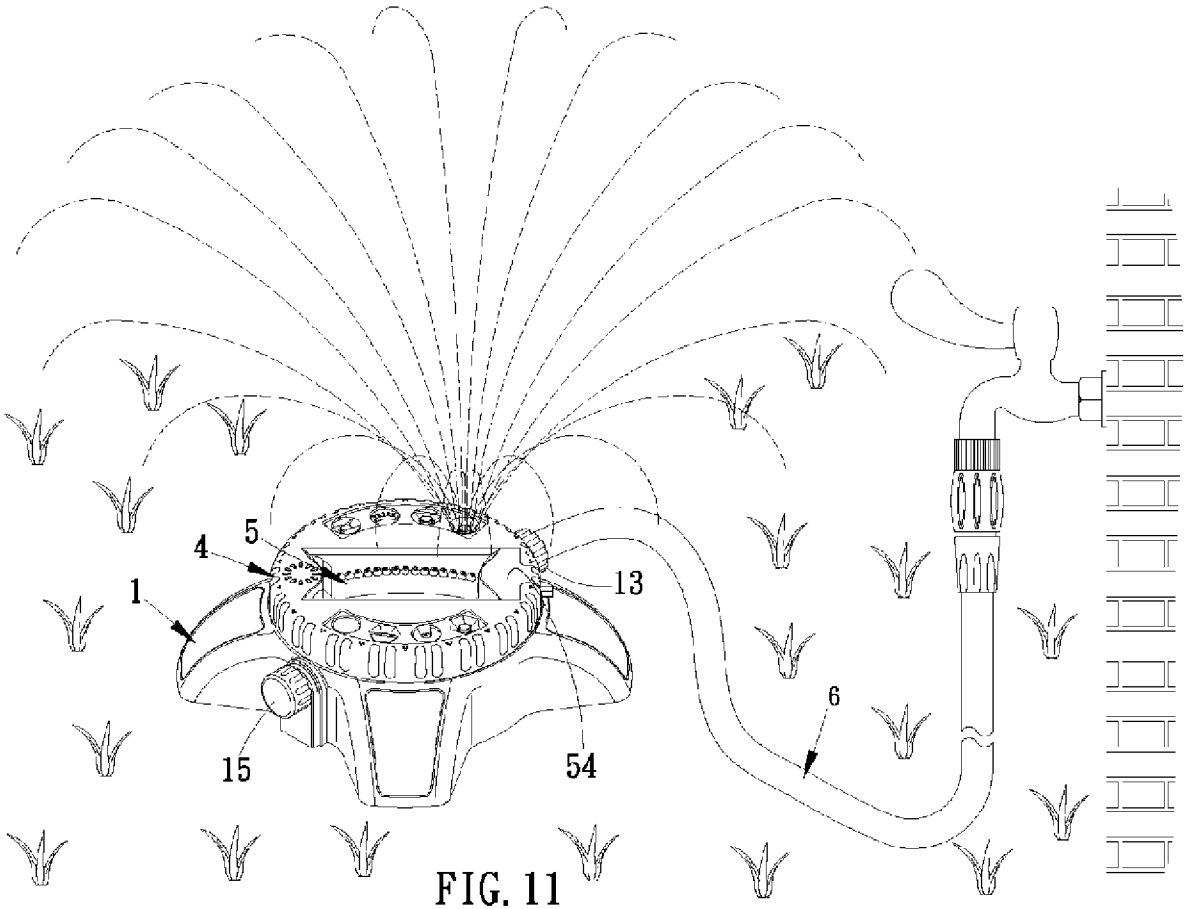
FIG. 11 is an illustrative view showing the watering device of the present invention spraying water.

Referring to FIGS. 10 and 11, in use, the inlet connector 13 of the base 1 is connected to one end of a water supply pipe 6. Then the water-dispensing basin 2 and the spraying cover 4 are rotated such that the arc-shaped inlet apertures 21 of the water-dispensing basin 2 are aligned with and connected to the inlet hole 12 of the base 1. Thus, water will flow to the inlet hole 12 via the water supply pipe 6 and will be sprayed out of the designated spraying apertures 41 of the spraying cover 4 after passing through the inlet apertures 21 and the water-separating board 22 of the water-dispensing basin 2.

Figure 12:
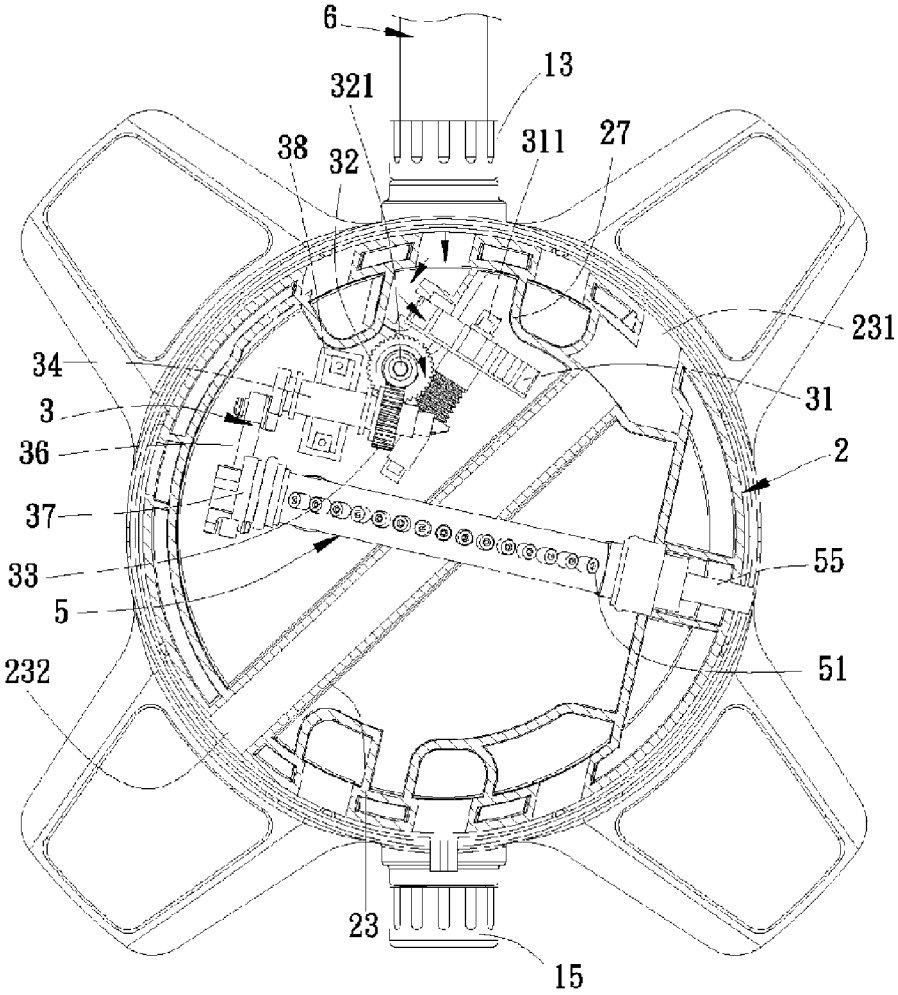
FIG. 12 is an operational view showing the swing outlet pipe in accordance with the present invention.
Figure 13:
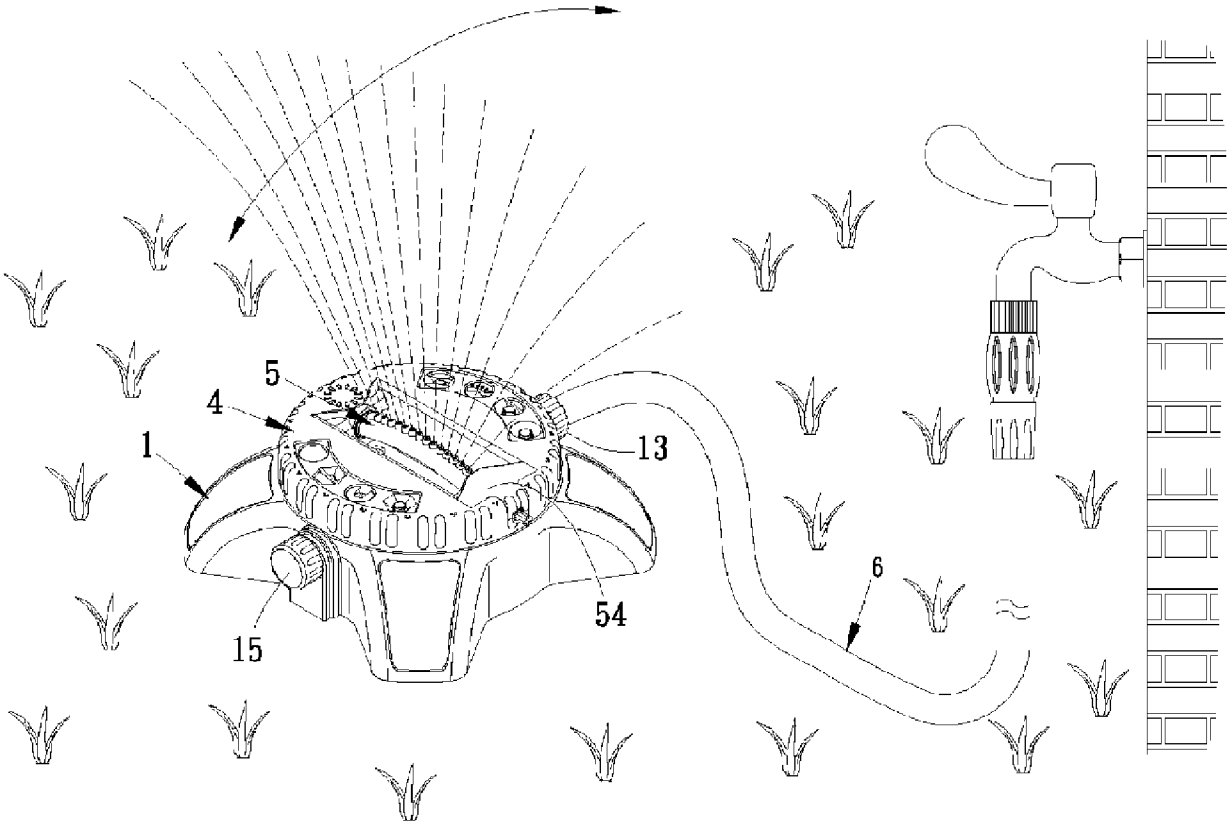
FIG. 13 is an illustrative view showing the watering device of the present invention spraying water in a swinging manner.

Alternatively, as shown in FIGS. 12 and 13, the water-dispensing basin 2 and the spraying cover 4 are rotated such that the arc-shaped inlet apertures 21 of the water-dispensing basin 2 are aligned with and connected to the inlet hole 12 of the base 1. Thus, the water will flow to the inlet hole 12 via the water supply pipe 6 and then flow into the water-dispensing basin 2 via the inlet apertures 21, so as to push the turbine wheel 31 of the swing device 3 to rotate. Then, through the drive member 32, the follower 33, the driven shaft 35 and the swing arm 36, the turbine wheel 31 is driven to reciprocate repeatedly by the swing device 3, thus driving the swing outlet pipe 5 to swing back and forth. When the water-dispensing basin 2 is full of water and the pressure therein reaches a certain level, the water will flow into the swing outlet pipe 5 via the inlet hole 52 and will be sprayed out via the spraying apertures 51.

Figure 14:
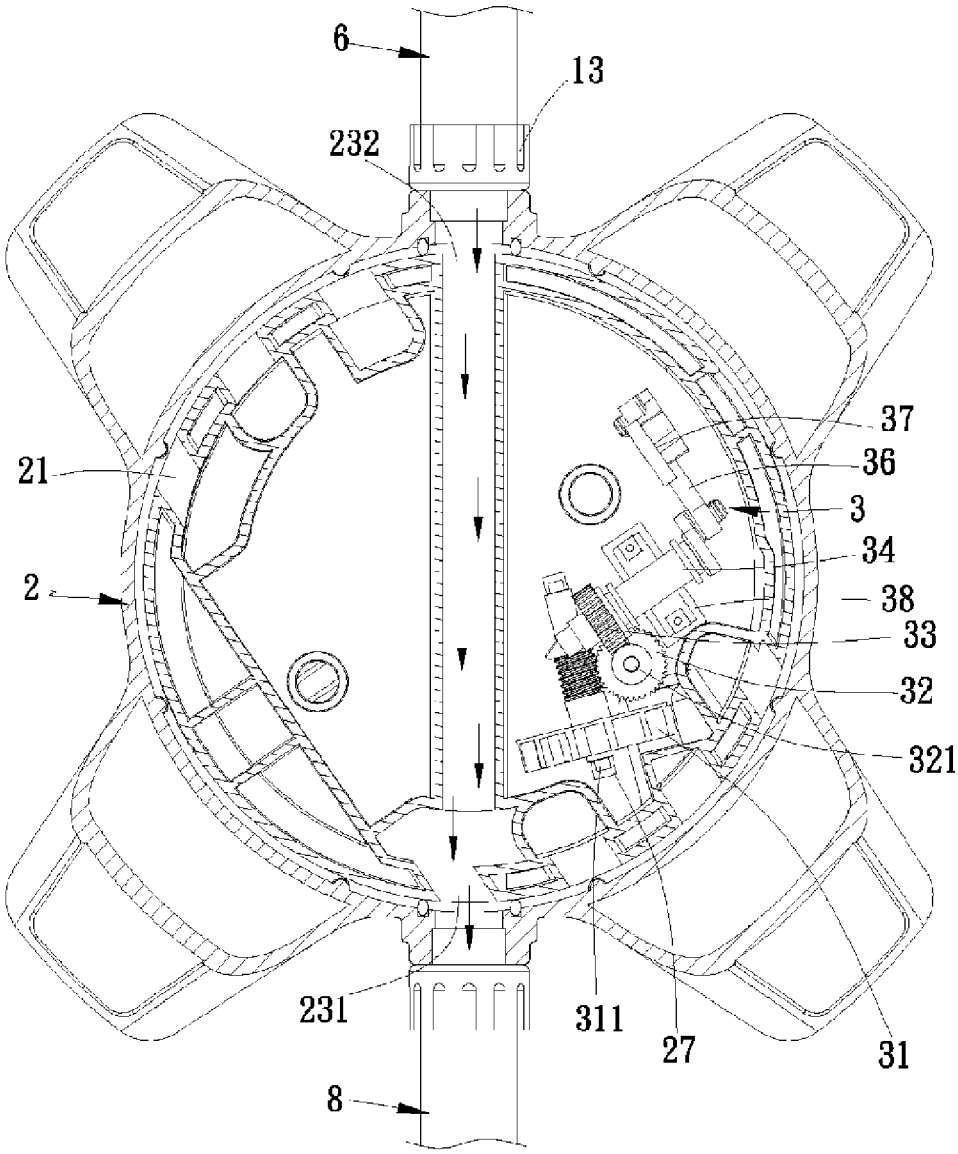
FIG. 14 is an operational view showing the spraying gun in accordance with the present invention.
Figure 15:
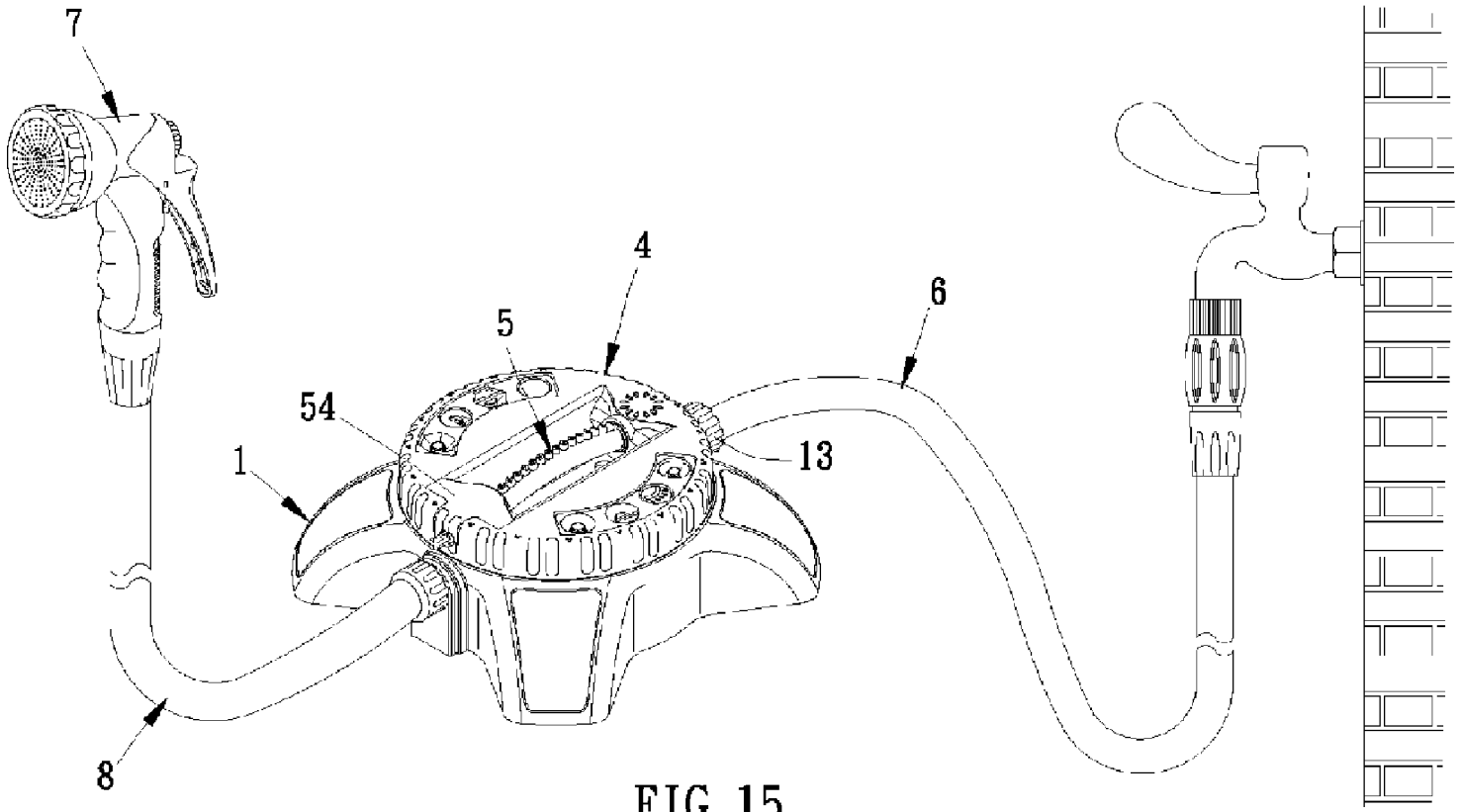
FIG. 15 shows the watering device of the present invention connected with a spraying gun.
Figure 16:
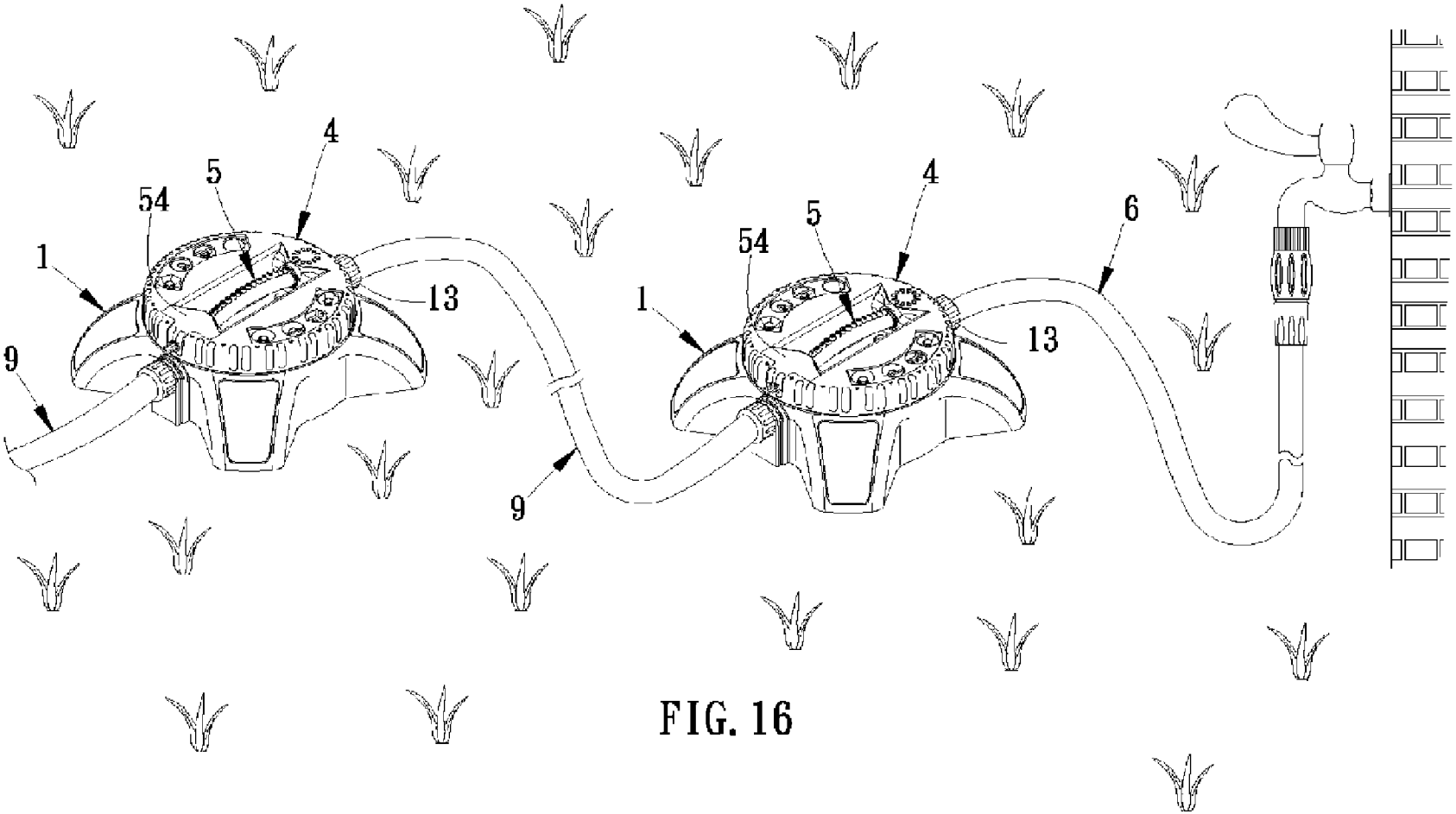
FIG. 16 shows two watering devices connected together.

Referring to FIGS. 14 and 15, if use of an exteriorly-connected spraying gun 7 to spray water is desired, the cover 15 can be taken off the outlet connector 14 of the base 1. Then the outlet connector 14 is connected with an extending pipe 8 and the spraying gun 7. The water-dispensing basin 2 and the spraying cover 4 are rotated such that the circular hole 231 of the water-supplying pipe 23 of the water-dispensing basin 2 is aligned with and connected to the inlet hole 12 of the base 1, and the arc-shaped hole 232 of the water-supplying pipe 23 is aligned with and connected to the outlet connector 14 of the base 1. Thus, the water will flow to the inlet hole 12 via the water supply pipe 6 and will be sprayed out of the spraying gun 7 after passing the water-supplying pipe 23 of the water-dispensing basin 2 and the outlet connector 14. Alternatively, as shown in FIG. 16, after taking off the cover 15, the outlet connector 14 of the base 1 can be connected to the outlet connector 14 of a base 1 of another watering appliance by a connecting pipe 9.

While various embodiments in accordance with the present invention have been shown and described, it is clear to those skilled in the art that further embodiments may be made without departing from the scope of the present invention.

What is claimed is:

1. A multi-stage swing horticultural watering appliance comprising: a base, a water-dispensing basin, a swing device, a spraying cover and a swing outlet pipe, the base being formed in a center thereof with a circular receiving recess, the water-dispensing basin being received in the circular receiving recess and being rotatable step by step, the swing device installed in the water-dispensing basin and including a turbine wheel, a drive member, a follower, a sleeve, a driven shaft, a swing arm, a link ring and a positioning member, the turbine wheel being rotatably mounted on two supporting rods inside the water-dispensing basin, the drive member being pivotally mounted on a hollow pillar inside the water-dispensing basin and meshed with the turbine wheel and the follower by teeth, the follower mounted on an end of the driven shaft, the sleeve being mounted on a mid portion of the driven shaft and then being placed on the positioning member mounted on supporting columns inside the water-dispensing basin, another end of the driven shaft being pivoted to an end of the swing arm, and another end of the swing arm pivoted to a link rod of the link ring, the spraying cover fixed on the water-dispensing basin by high frequency welding;

wherein an inlet hole and an outlet connector are arranged at two opposite sides of the receiving recess of the base, a plurality of inlet apertures is formed in an outer periphery of the water-dispensing basin, and in the water-dispensing basin are provided with a water-supplying pipe and a plurality of water-separating boards, in use, water flows through the inlet hole of the base and into the water-dispensing basin via the inlet apertures, a rectangular groove is formed in the spraying cover for accommodation of the swing outlet pipe, a through hole is formed in one end of the rectangular groove, the swing outlet pipe is formed with a plurality of spraying apertures, one end of the swing outlet pipe passes through the through hole of the rectangular groove and is connected to the link ring of the swing device, and in this one end of the swing outlet pipe is formed an inlet hole, water flow pushes the swing device to swing, thus driving the swing outlet pipe to swing back and forth, when the water-dispensing basin is full of water and the pressure therein reaches a certain level, the water will flow into the swing outlet pipe via the inlet hole thereof and will be sprayed out via the spraying apertures.

2. The multi-stage swing horticultural watering appliance as claimed in claim 1, wherein a -shaped sealing ring is disposed in the inlet hole of the base, an inlet connector is connected to a outer side of the inlet hole of the base, and the outlet connector is sealed with a cover.

3. The multi-stage swing horticultural watering appliance as claimed in claim 1, wherein the inlet apertures of the water-dispensing basin are arc-shaped.

4. The multi-stage swing horticultural watering appliance as claimed in claim 1, wherein a circular hole is formed at one end of the water-supplying pipe, and an arc-shaped hole is formed at another end of the water-supplying pipe for mating with the inlet apertures of the water-dispensing basin.

5. The multi-stage swing horticultural watering appliance as claimed in claim 1, wherein a mounting board and a notch are formed at another end of the rectangular groove of the spraying cover opposite the through hole thereof, and another end of the swing outlet pipe is mounted on the mounting board and is fixed thereon by a fixing board.

6. The multi-stage swing horticultural watering appliance as claimed in claim 1, wherein discharge holes are formed in a bottom of the rectangular groove for mating with the discharge pipes of the water-dispensing basin.

7. The multi-stage swing horticultural watering appliance as claimed in claim 1, wherein a threaded hole is formed in another end of the swing outlet pipe for screwing with a clean rod.

8. The multi-stage swing horticultural watering appliance as claimed in claim 1, wherein a die hole is formed in the bottom surface of the water-dispensing basin and is sealed with a sealing cover.

* * * * *